US008141197B2

(12) United States Patent
Allard

(10) Patent No.: US 8,141,197 B2
(45) Date of Patent: Mar. 27, 2012

(54) SPLASH GUARD FOR A FLOOR CLEANING MACHINE

(76) Inventor: Michael Allard, Goffstown, NH (US)

( * ) Notice: Subject to any disclaimer, the term of this patent is extended or adjusted under 35 U.S.C. 154(b) by 258 days.

(21) Appl. No.: 12/641,778

(22) Filed: Dec. 18, 2009

(65) Prior Publication Data

US 2011/0146020 A1 Jun. 23, 2011

(51) Int. Cl.
*A47L 11/40* (2006.01)

(52) U.S. Cl. ..... 15/246; 15/50.1

(58) Field of Classification Search ..... 15/50.1, 15/98, 246, 246.2, 325; 451/353, 451, 455
See application file for complete search history.

(56) References Cited

U.S. PATENT DOCUMENTS 2,981,966 A * 5/1961 Beffel ..... 15/246
3,010,135 A * 11/1961 Pollnow, Jr. ..... 15/246
3,122,769 A * 3/1964 Doersam ..... 15/246
3,153,251 A * 10/1964 Ohlson ..... 15/50.1
3,733,635 A * 5/1973 Carden ..... 15/49.1
5,280,663 A 1/1994 Proulx
D348,126 S 6/1994 Proulx
5,513,413 A 5/1996 Myers et al.
6,293,046 B1 9/2001 Meglino et al.
7,200,888 B2 4/2007 Nieson

FOREIGN PATENT DOCUMENTS

JP 8-89462 * 4/1996
JP 2002-360486 * 12/2002
JP 2005-110914 * 4/2005

* cited by examiner

*Primary Examiner* — Mark Spisich
(74) *Attorney, Agent, or Firm* — Daniels Patent Law PLLC; Scott A. Daniels

(57) ABSTRACT

The present invention relates to a splash guard that partially encircles a rotary floor cleaning apparatus allowing for support wheels to maneuver the apparatus when the rotary brushes are not in operation. The splash guard prevents cleansing material or debris from being splattered onto walls and other surfaces adjacent to the surface being cleaned.

17 Claims, 5 Drawing Sheets

SPLASH GUARD FOR A FLOOR CLEANING MACHINE

FIELD OF THE INVENTION

The present invention relates to a guard for a floor cleaning or buffing machine and more particularly to a splash guard that at least partially encompasses a scrubber pad of a rotary floor cleaning apparatus so as to prevent cleansing material or debris from being splattered onto walls and other surfaces adjacent to the surface being cleaned.

BACKGROUND OF THE INVENTION

Floor cleaning machines typically comprise a frame supporting a single or a number of motor-driven rotary pads or brushes, a motor, and a handle pivotally mounted to the frame. Because floor cleaning machines are quite heavy there are generally two support wheels attached to the back of machine that allow the machine to be tilted back onto the wheels and then more efficiently and easily moved when the machine is not undertaking a floor cleaning operation. When the device is in operation, it is set in an upright position and supported on the floor by the rotary pad or brush(es).

During operation the user guides the machine across the floor as the rotary pad or brush(es) are rotated by the motor at a relatively high speed to clean, buff, and/or abrade the floor surface. A cleaning substance e.g. fluid, waxes, pastes etc, are generally applied in some manner to the pad or brush(es) to facilitate floor cleaning. This rapid rotation of the pad or brush(es) with such cleaning substances, as well as dirt particles or debris, are frequently emitted from the brushes at a velocity great enough to spatter walls, furniture and other objects and surfaces. This is particularly undesirable as the splattered area or objects then need to be re-cleaned, resulting in time consuming additional work for the cleaning personnel. In addition, the splattered material can stain or otherwise permanently damage baseboards, furniture and the like.

Floor cleaning machines may also be hazardous to the operator because the rotary cleaning pads or brushes can entangle the machine's power cord. In the presence of cleaning solution contact with the power cord may result in electric shock to the worker. There are a number of known devices intended to prevent entanglement of the power cord and damage to work areas resulting from contact with floor cleaning machines and from cleaning solution splash. These are scrubber guards that entirely surround the rotary brushes, the scrubbing mechanism of a scrubbing machine. For example the splash guard of U.S. Pat. No. 5,513,413 to Myers is an elongate strip of flexible, waterproof material that is formed into a cylindrical shape by using a hook and loop type fastener, such as VELCRO® to adjust the length of the strip around the scrubbing machine. The scrubber guard of U.S. Pat. No. 5,280,663 to Proulx is also a flexible band that is placed over the top of the machine at the beginning of a cleaning operation and loosely surrounds the scrubbing machine awkwardly moving along with the machine as the brushes rotate. Each of these guards completely surround the floor scrubbing machine and support wheels and then must be removed at the end of the cleaning operation in order to pull the machine back onto the wheels to move the equipment when not in operation. The splash guard of U.S. Pat. No. 7,200,888 to Neisen contemplates an opening at the back of the splash guard, but includes two stiff metal rods that are used as complex connectors to adjust a flexible apron around the floor cleaning apparatus. These rods also prevent the scrubbing machine from being pulled onto the support wheels without removal of the splash guard.

The limitation of these and many other prior scrubber guards in weight, maneuverability and complexity require that improvements that overcome these difficulties be made. The present invention fulfills these needs and provides further related advantages as described in the following summary.

OBJECTS AND SUMMARY OF THE INVENTION

The object of the present invention is to provide an improved splash guard designed to prevent cleaning substances such as wax, liquid cleanser, debris and the like from being spattered and sprayed from the pad or brush(es) of a floor cleaning machine so as to prevent furniture, walls and other items from being stained while also significantly improving the efficiency of the floor cleansing process.

Another object of the invention is to reduce the amount of cleansing fluids used as the fluids are contained by the splash guard.

Another object of the invention is to fabricate a splash guard that consists of a rigid tubular bumper that completely surrounds the scrubbing machine, a pliable elongated housing that attaches to the tubular bumper but only partially surrounds the scrubbing machine and therefore does not interfere with the transport wheels of the machine.

It is yet another object of the invention to have a second tubular bumper attached to the complete upper portion of the elongated housing where the splash guard forms a complete ring at the base of the guard and an opening above the ring where the elongated housing and tubular top bumper do not completely encircle the scrubbing machine.

A still further object of the invention is for the tubular bumper that forms the ring to have a quick connection point where one end of the tubular bumper has an extender which is of a smaller diameter than the tubular bumper. This extender may be inserted into the other end of the tubular bumper and be frictionally fit to form a ring. A flexible sleeve or temporary adhesive may surround the connector to further lock the ring connection in place. The connection point may also take other forms such as protrusions on one end of the connector that insert into holes on the other end of the tubular bumper. A set of protrusions and holes or an extender that locks at various positions would provide for the diameter of the ring to be adjustable and able to accommodate different machines. Any connection strategy that is used would provide for easy separation of two tubular ends in order to quickly remove the scrub guard from the machine when not in use.

The lower tubular bumper of the splash guard forms a ring that contacts the floor around the scrubbing machine as the pad or brush(es) of the machine move in rotary motion. The housing and upper tubular bumper tightly circumferentially surround the base of the machine with minimal clearance of approximately 1" between the scrubbing machine body and the guard housing. This provides for sufficient maneuverability of the machine with the guard in place relative to walls and furniture as the machine moves in the rotary motion of the brushes. This minimal clearance enables the user to still cover most all surfaces without leaving any portions of the floor uncleaned for example next to walls, and around furniture or fixtures.

The lower tubular ring of the splash guard slides with minimal friction along the floor when the machine is in operation and so helps to prevent power cords from being pulled under the machine or tipping up of the guard when contact is made with a wall or surface due to the snugness of the housing around the machine body. The contact with the floor also prevents any splatter from escaping from the base of the scrubbing machine. The upper tubular bumper provides rigidity to the housing and protects wall surfaces and furniture from both splatter and gouging as the scrubbing machine comes in close contact with these surfaces. The upper tubular bumper may also have bumper caps to prevent any sharp edges of the bumper from doing damage.

The housing is of a pliable material such as plastic, polyethylene, or other polymer material that rigidly and flexibly surrounds a portion of the machine body. The thickness is approximately ⅛" and the dimensional height is between 3 and 6 inches to approximately match the height of standard baseboard used in commercial construction. The housing's elongated length is sufficient to surround a scrubbing machine body but leave a large enough gap to not interfere with support wheels of the machine. A distance of 1" to 2" inches between the edge of the elongated housing and the support wheels is left so that the machine when it is not in operation can be easily pulled back to rest on the support wheels without interference from the housing or upper tubular bumper of the splash guard. In this way a splattered, wet splash guard does not need to be removed from the machine and then reattached when the scrubbing machine is simply maneuvered over a doorway threshold to move the machine from one room to another to continue a scrubbing and cleaning operation in adjacent or near adjacent rooms.

The invention also relates to a splash guard for mounting around a floor scrubbing machine comprising a lower ring, a housing substantially attached around a portion of the ring, a upper bumper attached to the housing, and wherein the lower ring completely surrounds the floor scrubbing machine and the housing surrounds a substantial portion of the machine.

The invention further particularly relates to an adjustable splash guard for mounting around a floor scrubbing machine, comprising, a lower ring having a quick disconnect fitting, a housing substantially attached around a portion of the ring, an upper bumper attached to the housing and the disconnect fitting of the lower ring is adjustable to completely surround the floor scrubbing machine, and wherein the housing surrounds a substantial portion of the machine.

These and other features, advantages and improvements according to this invention will be better understood by reference to the following detailed description and accompanying drawings.

DETAILED DESCRIPTION OF THE INVENTION

Figure 1:
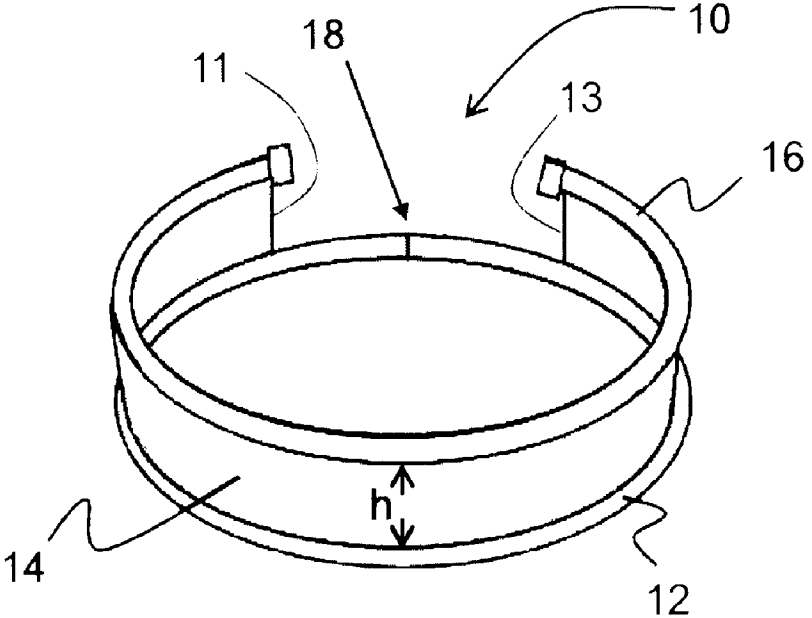
FIG. 1 is a perspective front view of the present invention.

A front view of the splash guard apparatus 10 is shown in FIG. 1 and consists of a circumferential lower bumper 12, a pliable housing 14, and a partially circumferentially encompassing upper tubular bumper 16. The pliable housing 14 is attached to and substantially around a portion of the ring that is formed when the lower bumper 12 is connected at the quick connection point 18. The pliable housing 14 is made from a material flexible enough to bend in a radial manner around a central axis A, but rigid enough so that the housing 14 does not bend or collapse in an axial manner relative to axis A. The axial height h of the housing may be from 1-10 inches but is preferably about 3-6. The upper tubular bumper 16 may attach to the full length of the pliable housing 14 or may extend ½" to 1½" past the ends of the housing 14 in order to attach bumper caps 20 that enclose the tubular bumper ends for protection from scraping or gouging by the tubular ends.

Figure 2:
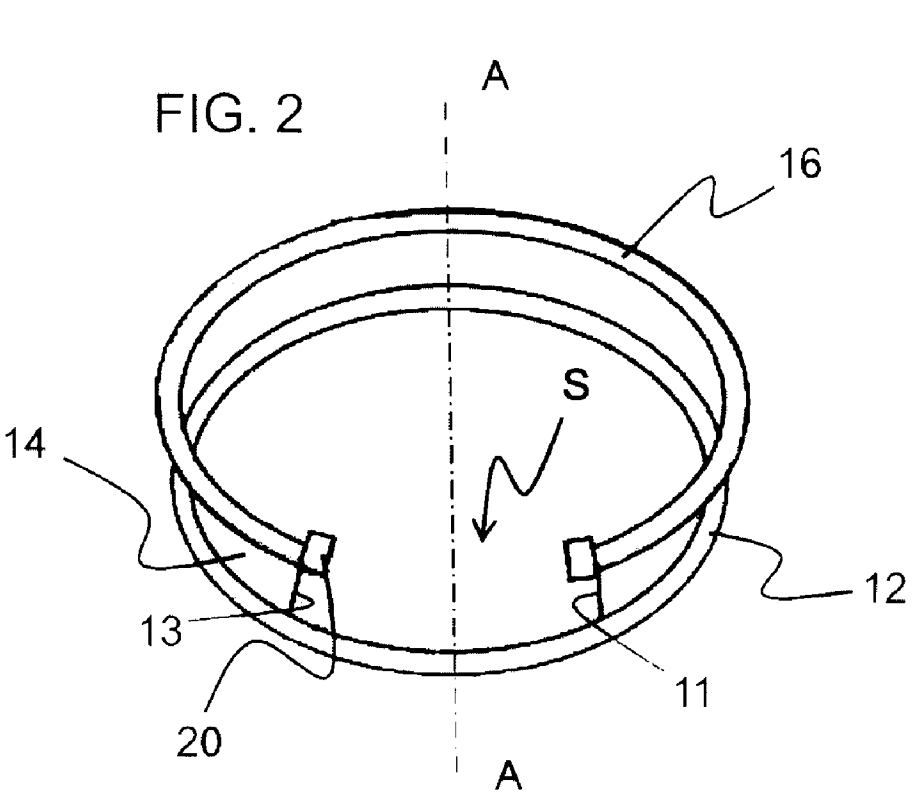
FIG. 2 is a perspective rear view of the present invention.
Figure 4:
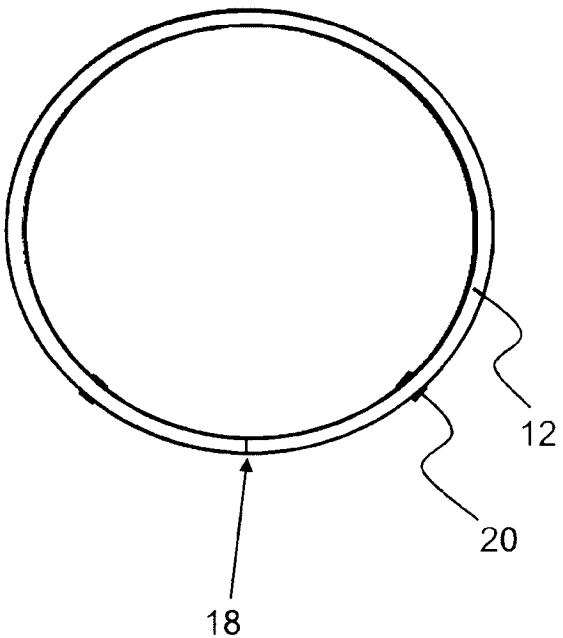
FIG. 4 is a bottom view of the splash guard with a connection of the quick connector.
Figure 3:
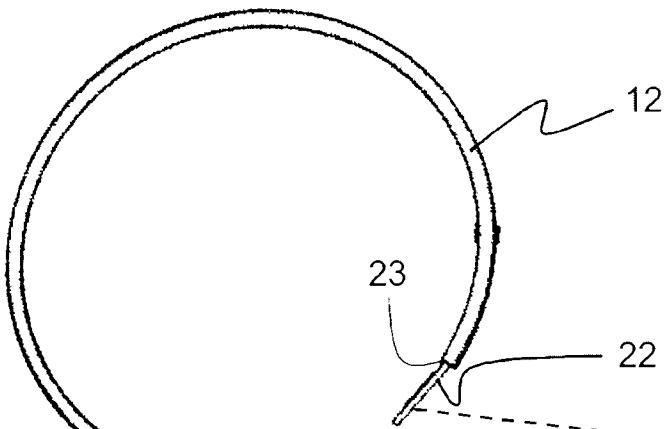
FIGS. 3 and 3A is a bottom view of the present invention showing one means for attachment using an adjustable quick connector.

The rear view of the splash guard apparatus 10 as shown in FIG. 2 shows the gap or space S defined between the first end 11 and the second end 13 of the housing 14 and upper tubular bumper 16. The space S is important because as discussed in further detail below this permits the transport wheels 36 to extend through the space S and beyond the circumference of the apparatus 10 so that the floor cleaning machine can still be easily tilted and transported with the splash guard apparatus 10 in place around the frame of the machine. The lower tubular bumper 12 shown here in FIG. 2 is connected at the quick connector 18 and is completely circumferential as seen more clearly in FIGS. 3, 3A and 4. The lower bumper 12 is frictionally connected using an extender 22 that is inserted into a central passage of the first end 23 of the lower bumper 12 and extends out from the first end 23 of the lower tubular bumper 12. The extender 22 is of a similar diameter as the central passage of the lower tubular bumper 12 and may be a material that provides sufficient friction to grip the inside surface of the central passage so that it is not too easily removed.

To connect the ends of the lower bumper 12 to make a completely circumferential ring of the lower bumper 12, the opposite end of the extender 22 is inserted into the central passage of the second end 24 of the lower tubular bumper 12. Where the central passage is again a similar diameter to that of the extender 22. A pressured frictional fit is formed that holds the two ends 23, 24 of the lower bumper 12 in place. Using a frictional pressure fit the two tubular ends, 23, 24 may be relatively easily separated by a user manually pulling apart on each of the tubes making for easy removal of the splash guard apparatus from a floor cleaning machine if necessary.

Figure 3A:
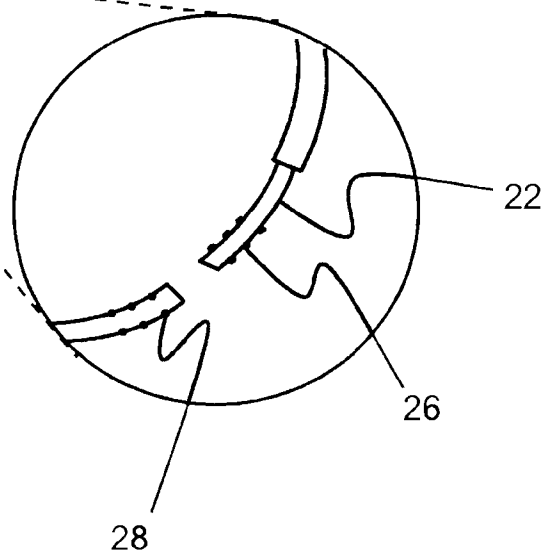

In a further embodiment, as shown in FIG. 3A, protrusions or nodules 26 may be formed on the extender 22 and indentations or holes 28 may be formed in the tubular open end 24 to receive the protrusions or nodules 26. By selecting which nodule 26 and indentation 28 to mate, the diameter of the lower tubular ring 12 may be adjusted to accommodate diameters of different floor cleaning machines. A sleeve or other connection support (not shown) may also be placed around the connection point 18 to further secure the lower tubular ring 12 in place if necessary. Other embodiments such as the use of a loop and hook or other hardware connection may be used to secure the lower tubular ring, however any method employed must require little or no effort to separate the tubes in order to easily remove the splash guard apparatus from the floor cleaning machine. The splash guard apparatus is shown from the bottom planar perspective in FIG. 4 with the lower tubular bumper 12 connected at the connection point 18 to form a ring.

Figure 5:
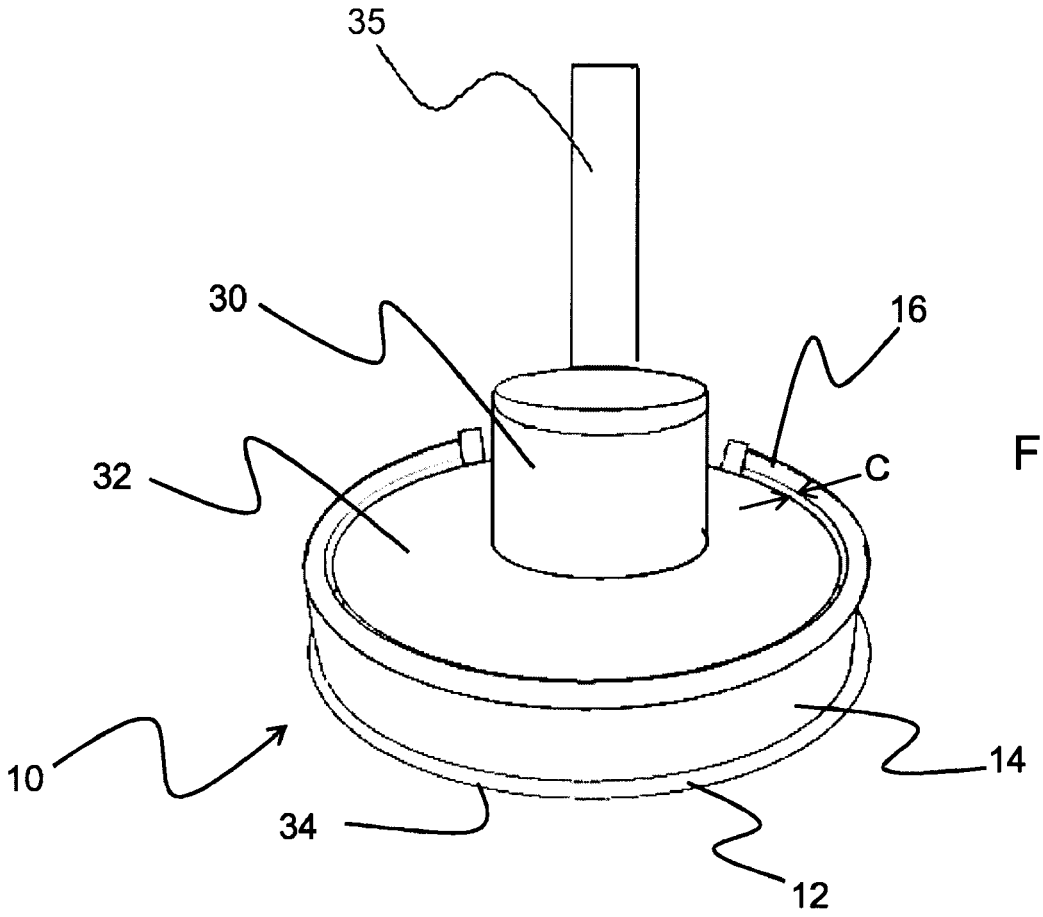
FIG. 5 is a front view of a preferred embodiment of the present invention, particularly showing the splash guard as properly secured around a floor cleaning apparatus.

The splash guard apparatus 10 is shown in FIG. 5 encompassing a floor cleaning machine 30 from a front view of the machine. It is an important aspect of the present invention that the splash guard apparatus 10 is not directly attached by a fastening to the cleaning machine 30 or body of the cleaning machine in any manner. The splash guard apparatus 10 is designed to closely encompass the body 32 and pad or brush (es) with the lower bumper 12 resting on the floor being cleaned while essentially floating freely relative to the movement of the cleaning machine 30 and the pad or brush(es). The housing 14 partially surrounds the body 32 of the floor cleaning machine 30 with a minimal clearance C of approximately ½" to 1½ between the machine body 32 and the splash guard apparatus 14. This allows for the splash guard 10 to move, or float, in sync with the movements of the floor cleaning machine 30 even though it is not directly attached to the machine 30.

This also provides for another aspect of the apparatus that the clearance C is not constant around the machine body 32 during operation. The machine 30 and guard 10 flow in movement and an operator can bring the machine in close to a wall surface for example which pushes the splash guard apparatus 10 closer to the body of the machine 32 along the wall to ensure that the complete floor surface is cleaned while still protecting the wall from splashing of cleaning substances because the bottom bumper 12 of the apparatus 10 remains in constant contact with the floor. Concurrently, and the apparatus 10 has a clearance C farther from the body 32 on the opposing side of the machine 30 away from the wall in such operations.

Without such variable clearance C the known splash guards can ricochet the machine 30 off in all directions making maneuverability of the machine and splash guard very difficult. The minimal clearance C also assists in maintaining the lower tubular bumper 12 on the floor and prevents the guard from tipping up when a wall or surface is hit by the guard when the machine is operating. The contact with the floor and the rounded bottom edges 34 of the lower tubular bumper 12 also helps to prevent power cords or other articles from being drawn into the rotary brushes of the floor cleaning machine, preventing hazardous situations and injuries.

The height h of the housing 14 is sufficient to prevent cleaning fluids or debris from exiting above the upper tubular bumper 16 and thus reduces the amount of cleaning fluids used as fluids are contained within the scrub area of the brushes. This height h of the housing 14 may be 3-6 inches, similar to standards for baseboards and other moldings commonly used around floor edges in general and commercial construction, or it may be in the range of 1-10 inches depending on the application. Because of the nature of the space S for the support wheels 36 on the rear of the floor cleaning machine the height h of the housing 14 is not limited by a necessity to accommodate the support wheels 36 or the handle 35 that extends from the rear of the floor cleaning machine 30.

Figure 6:
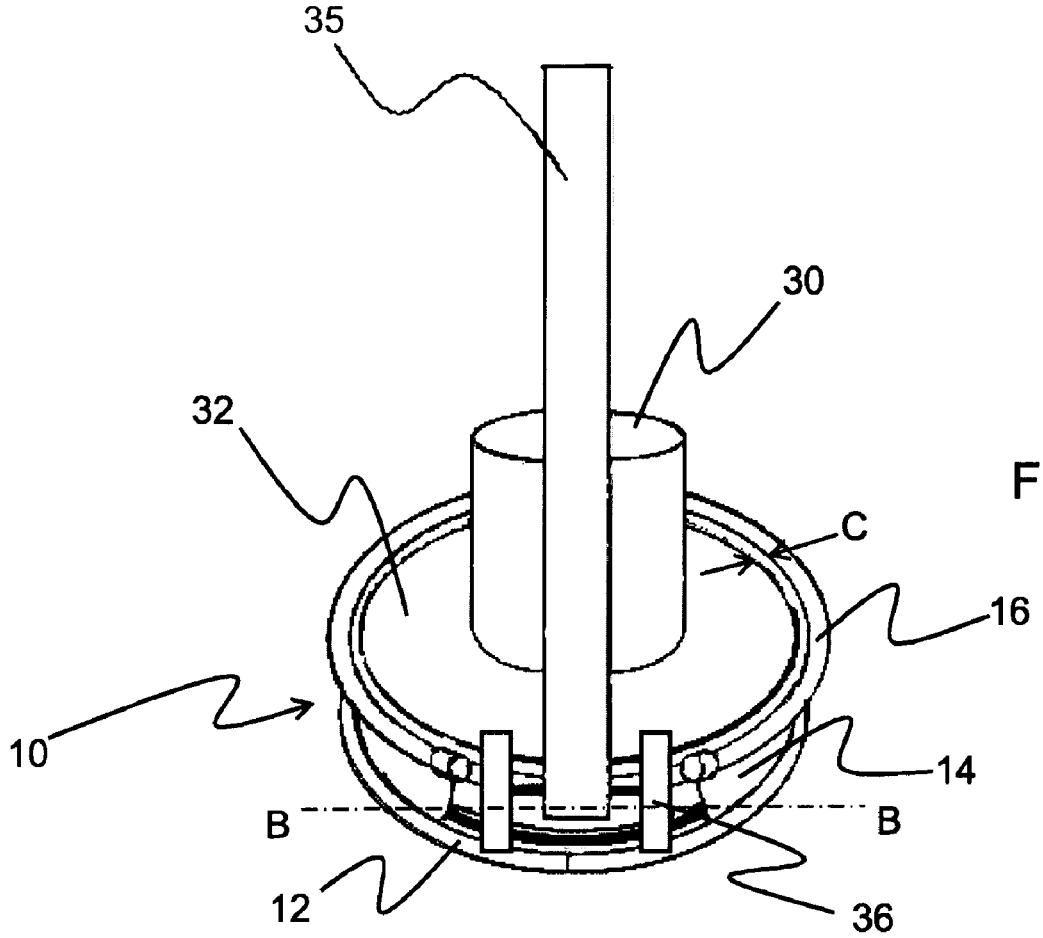
FIG. 6 is a rear view of a preferred embodiment of the present invention, particularly showing the splash guard as properly secured around a floor cleaning apparatus.
Figure 7:
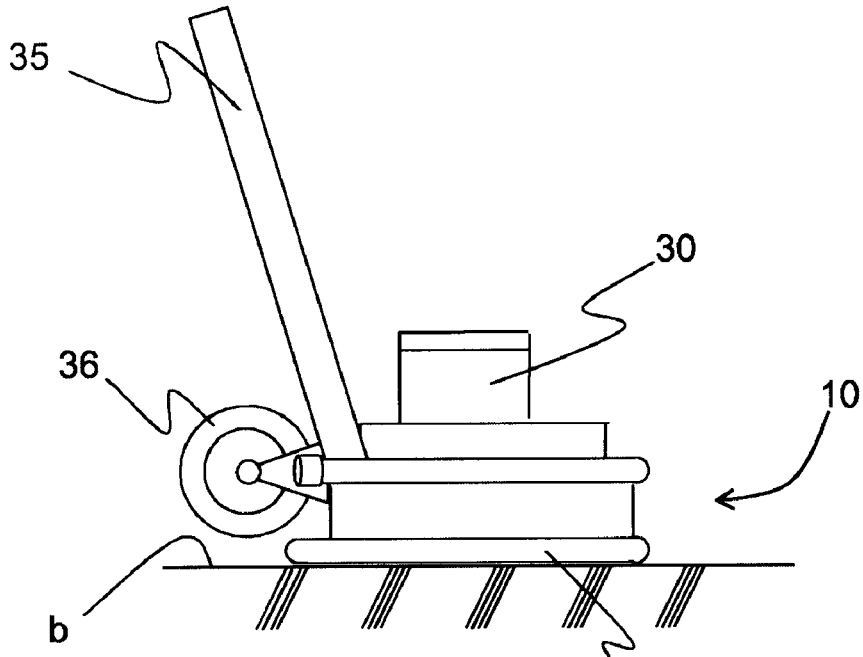
FIG. 7 is a side view of the splash guard as properly secured around a floor cleaning apparatus in an operating position.
Figure 8:
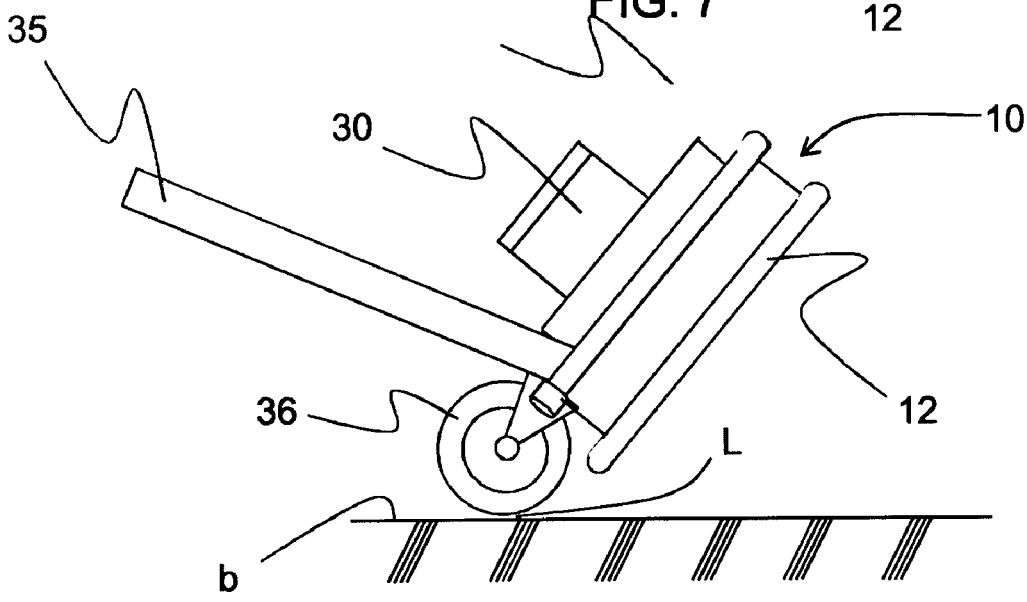
FIG. 8 is a side view splash guard as properly secured around a floor cleaning apparatus that is tilted back on its support wheels when not in operation.

From a rear perspective of the machine, as shown in FIG. 6 the housing 14 is snugly fit around the machine body 32 with a clearance C and the transport wheels 36 which are generally affixed along an axis B extend out through the space S between each end of the housing 14 and upper bumper 16. In this position the axis B also defines a plane b which is perpendicular to the floor. The transport wheels 36 in a first position of the machine 30 shown in FIG. 7 wherein the wheels are out of contact with the floor when the machine is in an operational position with the pad or brush(es) element contacting and aligned parallel with the floor. The transport wheels 36 are shown in a second position of the machine 30 as seen in FIG. 8 with the wheels in contact with the floor when the machine is tilted back for transportation with the pad or brush(es) out of contact with the floor and generally not planarly or in parallel alignment with the floor. Important to the transportability of the present invention, at least the end points of the axis B about which the wheels are supported are outside the circumference of the splash guard apparatus 10. This means that more than half of the circumference of the transport wheels 36 are also outside the circumference of the splash guard apparatus 10. In this manner when the machine is tilted back by the operator so that the plane b is no longer parallel with the floor, the contact point L of the wheels 36 with the ground is also outside the circumference of the splash guard apparatus 10 so that no interference with transport of the machine is caused by the splash guard apparatus 10.

In other words, the axis B extends generally above and outside the circumference of the lower tubular ring 12 facilitating transport of the floor cleaning machine in the second position shown in FIG. 8. In use, the rotary brush motor of the floor cleaning machine 30 is simply shut down and the machine is rocked or tilted back onto the support wheels 36. The splash guard 10 does not fall off, or need to be removed when the machine 30 is tilted, but the splash guard apparatus 10 actually remains substantially supported or resting on the body 32 of the machine 30 because of the relatively small clearance C. The splash guard apparatus 10 thus remains in place and tilts up with the body 32 of the machine in the second position and is transported with the machine 30. A common limitation of much of the prior art is the requirement of the removal of the splash guard in order to use the support wheels 36 and move the machine 30 when not in operation. In the present invention there is no requirement of removal of the splash guard 10 and yet if necessary the splash guard apparatus 10 is easily removed from the machine 30 for cleaning of the splash guard and storage.

Since certain changes may be made in the above-described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A splash guard for mounting around a floor scrubbing machine, comprising;

a tubular lower bumper having a rounded bottom edge for contact with the floor and extending between a first end and a second end, and the tubular lower bumper further defines a central passage having a first diameter extending between the first and second ends;

a housing attached at a lower edge around a portion of the tubular lower bumper;

an upper bumper attached to an upper edge of the housing;

the tubular lower bumper completely surrounds the floor scrubbing machine and the housing surrounds a portion of the machine; and wherein a quick connector comprising an extension having a second diameter substantially similar to the first diameter to frictionally engage within the central passage of the tubular lower bumper and connects the first and second ends of the lower bumper solely by a frictional grip on the inside surface of the central passage.

2. The splash guard as claimed in claim 1 wherein the housing surrounds the floor scrubbing machine at a distance of about ½ to 1½ and the splash guard is not directly attached to the floor scrubbing machine during operation.

3. The splash guard as claimed in claim 1 comprising a space defined in the housing between which support wheels of the floor scrubbing machine extend.

4. The splash guard as claimed in claim 3, wherein said housing that surrounds a portion of the machine has two spaced-apart edges defining the space between which the support wheels of the scrubbing machine extend.

5. The splash guard as claimed in claim 1 wherein the housing may have a height between 3" and 6" and cleansing fluid is contained within the diameter of the splash guard.

6. The splash guard as claimed in claim 1, wherein the housing is a pliable material of flexible polyethylene sheeting material having a thickness of about ⅛ inch.

7. A splash guard for mounting around a floor cleaning machine, the splash guard comprising;

a tubular lower bumper having a rounded bottom edge for contact with the floor and extending between first and second ends of the tubular lower bumper and an upper bumper spaced apart by a sidewall extending there between;

the first and second ends of the tubular lower bumper having a connection mechanism for securing the splash guard in an operational position wherein the lower bumper forms a contiguous ring;

first and second ends of the sidewall remain spaced apart to define an opening in the splash guard to accommodate transport wheels of the floor cleaning machine; and wherein the connection mechanism comprises the tubular lower bumper defining a central passage having a first diameter extending between the first and second ends; and an extension is provided having a second diameter substantially similar to the first diameter to frictionally engage within the central passage of the lower bumper and circumferentially connect the first and second ends of the lower bumper.

8. The splash guard as set forth in claim 7 further comprising an operational position with the splash guard encompassing the floor cleaning machine wherein the transport wheels of the floor cleaning machine extend through the opening in the splash guard and are spaced from a floor surface.

9. The splash guard as set forth in claim 8 further comprising a transport position with the splash guard encompassing the floor cleaning machine wherein the transport wheels of the floor cleaning machine extend through the opening in the splash guard and are in contact with the floor surface.

10. The splash guard as set forth in claim 9 wherein in the operational position the splash guard encompasses the floor cleaning machine and is supported solely by the floor surface to define a variable clearance between an outer diameter of the floor cleaning machine and an inside diameter of the splash guard when the floor cleaning machine is in operation.

11. The splash guard as set forth in claim 10 wherein in the transport position the splash guard encompasses and rests on the floor cleaning machine when the transport wheels are in contact with the floor surface.

12. The splash guard as set forth in claim 11 wherein a rotational axis of the transport wheels is spaced radially outside an outer diameter of the splash guard in at least the operational position.

13. A method for mounting a splash guard around a floor cleaning machine, the method comprising the steps of;

forming a tubular lower bumper and an upper bumper spaced apart by a sidewall extending there between;

connecting first and second ends of the lower bumper to form a contiguous ring; and maintaining a spacing between first and second ends of the sidewall to define an opening in the splash guard to accommodate transport wheels of the floor cleaning machine;

forming the lower bumper having a tubular rounded bottom edge for contact with the floor, and defining a central passage in the lower bumper having a first diameter extending between the first and second ends of the lower bumper; and providing a quick connector for connecting the first and second ends of the lower bumper, the quick connector comprising an extension having a second diameter substantially similar to the first diameter to frictionally engage within the central passage of the lower bumper and circumferentially connect the first and second ends of the lower bumper.

14. The method for mounting a splash guard around a floor cleaning machine as set forth in claim 13 further comprising an operational position with the splash guard encompassing the floor cleaning machine wherein the transport wheels of the floor cleaning machine extend through the opening in the splash guard and are spaced from a floor surface.

15. The method for mounting a splash guard around a floor cleaning machine as set forth in claim 14 further comprising a transport position with the splash guard encompassing the floor cleaning machine wherein the transport wheels of the floor cleaning machine extend through the opening in the splash guard and are in contact with the floor surface.

16. The method for mounting a splash guard around a floor cleaning machine as set forth in claim 15 further comprising in the operational position the splash guard encompasses the floor cleaning machine and is supported solely by the floor surface to define a variable clearance between an outer diameter of the floor cleaning machine and an inside diameter of the splash guard when the floor cleaning machine is in operation.

17. The method for mounting a splash guard around a floor cleaning machine as set forth in claim 16 further comprising in the transport position the splash guard encompasses and rests on the floor cleaning machine when the transport wheels are in contact with the floor surface.

* * * * *